US011591836B1

(12) United States Patent
Johnson

(10) Patent No.: US 11,591,836 B1
(45) Date of Patent: Feb. 28, 2023

(54) DOOR PROP APPARATUS AND METHODS OF USE

(71) Applicant: Scott W. Johnson, Pelham, AL (US)

(72) Inventor: Scott W. Johnson, Pelham, AL (US)

( * ) Notice: Subject to any disclaimer, the term of this patent is extended or adjusted under 35 U.S.C. 154(b) by 0 days.

(21) Appl. No.: 17/898,029

(22) Filed: Aug. 29, 2022

(51) Int. Cl.
*E05C 17/30* (2006.01)
*E05C 17/54* (2006.01)
*E05C 19/18* (2006.01)
*E05B 15/02* (2006.01)

(52) U.S. Cl.
CPC ..... *E05C 17/30* (2013.01); *E05B 15/021* (2013.01); *E05C 17/54* (2013.01); *E05C 19/182* (2013.01)

(58) Field of Classification Search
CPC ..... E05C 17/30; E05C 17/54; E05C 19/18; E05C 19/182; E05C 19/184; E05C 19/186; E05C 19/188; E05C 17/52; E05B 15/021
USPC ..... 292/262, 288, 275, 339, 343
See application file for complete search history.

(56) References Cited

U.S. PATENT DOCUMENTS 2,200,627 A * 5/1940 Levy ..... E05C 17/30 292/262
2,505,320 A * 4/1950 Bernhard ..... E05C 17/166 292/269
3,387,875 A * 6/1968 White ..... E05C 17/30 292/262
3,620,483 A * 11/1971 Morris ..... E05C 17/54 16/86 A
4,634,170 A * 1/1987 Lach ..... E05C 17/30 296/76
5,381,628 A * 1/1995 D'Hooge ..... E05C 17/28 16/49
6,550,828 B2 * 4/2003 Warden ..... E05C 17/54 292/288
7,226,094 B2 * 6/2007 Swink ..... E05C 17/50 292/DIG. 19
8,177,266 B2 * 5/2012 Yates ..... E05C 17/54 292/288
8,376,422 B2 * 2/2013 Swink ..... E05C 17/52 292/288
8,727,404 B2 * 5/2014 Martin ..... E05B 17/005 292/341.14
8,959,960 B2 * 2/2015 Hill ..... D06F 39/12 68/3 R (Continued)

FOREIGN PATENT DOCUMENTS

FR 2835559 8/2003
WO 2003080973 10/2003

*Primary Examiner* — Jeffrey O'Brien
(74) *Attorney, Agent, or Firm* — Taylor English Duma

(57) ABSTRACT

The door prop apparatus disclosed herein is configured to secure a door in a partially opened position relative to a door frame defining a doorway, in various aspects. The door prop apparatus includes a mounting member adapted to attach to the door frame latch jamb and thereby secure the apparatus to the latch jamb, in various aspects. The door prop apparatus includes a latch receiving member adapted to receive the door latch therein, in various aspects. As the door is urged from an open position towards a closed position, the latch receiving member receives the door latch therein and thereby secures the door in the partially opened position, in various aspects. The door handle is operable to retract the latch into the door and thereby release the door from the secured partially opened position, in various aspects. Related methods are disclosed.

12 Claims, 6 Drawing Sheets

(56) References Cited

U.S. PATENT DOCUMENTS

| | | | | |
|---|---|---|---|---|
| 9,316,033 | B2 * | 4/2016 | Yates | E05C 17/54 |
| 9,938,757 | B2 * | 4/2018 | Raffi | E05C 19/188 |
| 2010/0060020 | A1 * | 3/2010 | Swink | E05B 15/021 292/341 |
| 2014/0312635 | A1 * | 10/2014 | Hansen | E05C 17/54 292/343 |
| 2017/0204641 | A1 * | 7/2017 | Maher | E05C 17/30 |
| 2017/0306667 | A1 * | 10/2017 | Mitchell | E05C 17/30 |
| 2020/0208447 | A1 * | 7/2020 | Farkas | E05C 17/54 |
| 2022/0170300 | A1 * | 6/2022 | Dutton | E05C 19/182 |

* cited by examiner

DOOR PROP APPARATUS AND METHODS OF USE

FIELD OF THE INVENTION

This disclosure relates to a door prop apparatus for securing a door in a partially opened position relative to a door frame, and related methods of use.

BACKGROUND OF THE INVENTION

A common door frame assembly includes a door frame having a top head jamb, a side hinge jamb, a side latch jamb, and a bottom threshold that collectively define the doorway through the door frame. The door frame assembly may include a door hingedly mounted to the hinge jamb so that the door can pivot between an open position and a closed position. The door may include a latch assembly having a handle, such as a rotatable handle or doorknob, which cooperates with a latch to retract and extend the latch. The latch jamb may include a strike plate having an opening therethrough for receiving the door latch. When the door is in the closed position, the latch may extend through the strike plate opening to secure the door in the closed position. The door handle may have a home position with the latch in an extended position to maintain the latch secured through the strike plate opening and the door secured in the closed position. The door handle may be rotated to retract the latch from the strike plate opening and thereby allow the door to be pivoted open.

It some circumstances, it may be desirous to reversibly secure a door in a partially opened position relative to a door frame, for example, to allow a pet to move freely through the doorway. Accordingly, there is a need for an improved door prop apparatus as well as related methods of use for securing a door in a partially opened position relative to a door frame.

BRIEF SUMMARY OF THE INVENTION

These and other needs may be overcome by the apparatus and methods disclosed herein. Additional improvements and advantages may be recognized by those of ordinary skill in the art upon study of the present disclosure.

A door prop apparatus and related methods, as disclosed herein, is adapted to secure a door in a partially opened position relative to a door frame defining a doorway, in various aspects. The door prop apparatus may include a mounting member adapted to attach to the door frame side latch jamb and thereby secure the apparatus to the latch jamb, in various aspects. The mounting member may replace a pre-existing strike plate on the latch jamb, in various aspects. The door prop apparatus may include a latch receiving member adapted to receive the door latch therein, in various aspects. The latch receiving member may receive and reversibly secure the latch in the latch receiving member as the door is urged from an open position towards a closed position, in various aspects. The door may be reversibly secured in a partially opened position when the latch is secured within the latch receiving member and the mounting member is attached to the latch jamb, in various aspects. The door handle may be operable to retract the latch into the door and thereby release the door from the secured partially opened position, in various aspects. The door prop apparatus may include an extension member between the mounting member and the latch receiving member, in various aspects. The length of the extension member may be adjustable to vary the distance between the mounting member and the latch receiving member, in various aspects. The door prop apparatus may include a biasing member adapted to guide the latch toward the latch receiving member as the door is urged from an open position towards a closed position, in various aspects. The door prop apparatus may include a door stop member adapted to prevent the door from advancing past the door stop member as the door is urged from an open position towards a closed position, in various aspects. The door prop apparatus may include another biasing member adapted to engage the side latch jamb and thereby bias the latch receiving member towards an axis through the doorway, in various aspects.

This summary is presented to provide a basic understanding of some aspects of the apparatus and methods disclosed herein as a prelude to the detailed description that follows below. Accordingly, this summary is not intended to identify key elements of the apparatus or methods disclosed herein or to delineate the scope thereof.

Figure 1:
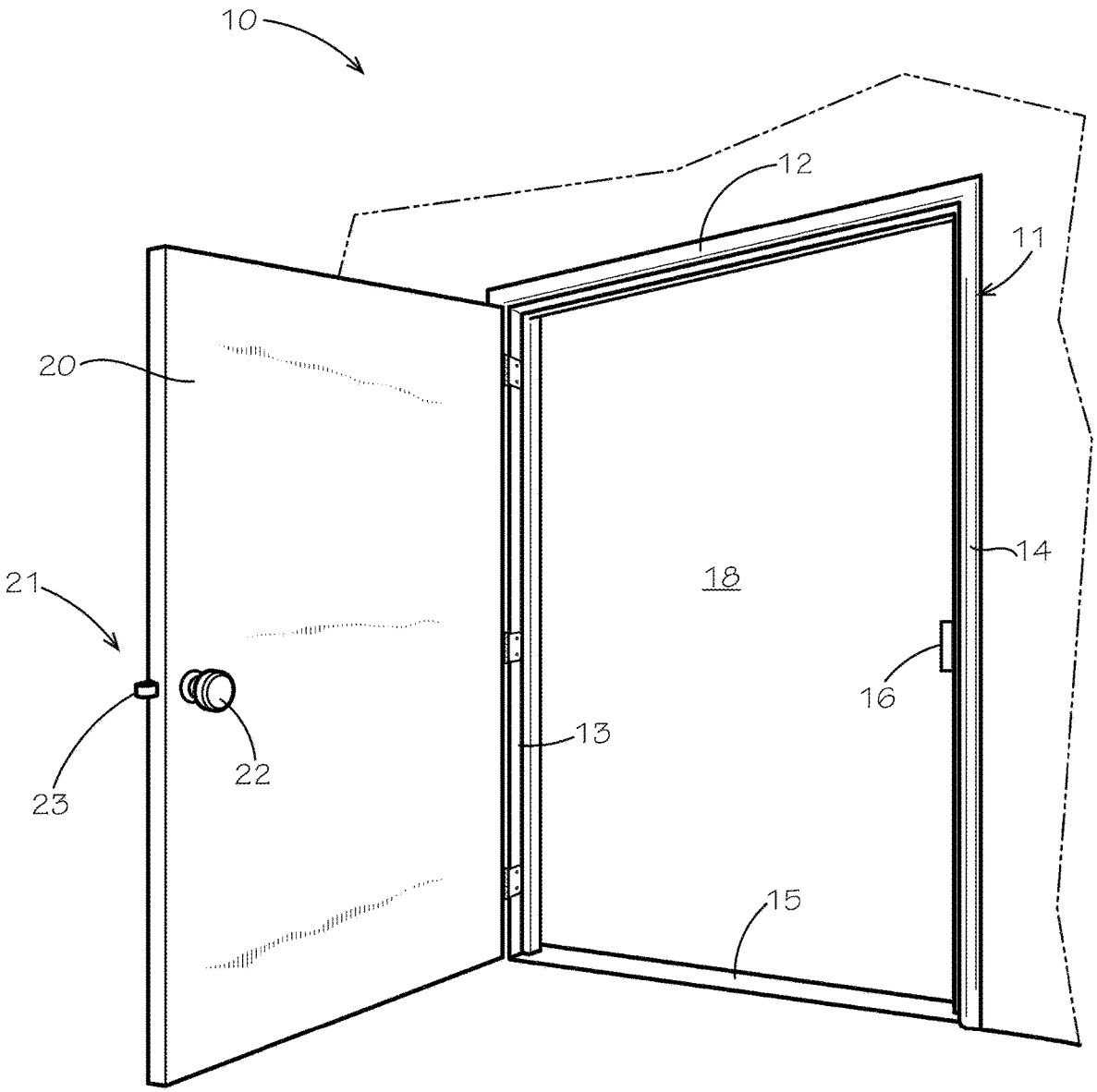
PRIOR ART FIG. 1
FIG. 1 illustrates by perspective view an exemplary door frame assembly.

The Figures are exemplary only, and the implementations illustrated therein are selected to facilitate explanation. The number, position, relationship and dimensions of the elements shown in the Figures to form the various implementations described herein, as well as dimensions and dimensional proportions to conform to specific force, weight, strength, flow and similar requirements are explained herein or are understandable to a person of ordinary skill in the art upon study of this disclosure. Where used in the various Figures, the same numerals designate the same or similar elements. Furthermore, when the terms "top," "bottom," "right," "left," "forward," "rear," "first," "second," "inside," "outside," and similar terms are used, the terms should be understood in reference to the orientation of the implementations shown in the drawings and are utilized to facilitate description thereof. Use herein of relative terms such as generally, about, approximately, essentially, may be indicative of engineering, manufacturing, or scientific tolerances, or other such tolerances, as would be readily recognized by those of ordinary skill in the art upon study of this disclosure.

DETAILED DESCRIPTION OF THE INVENTION

FIG. 1 illustrates an exemplary door frame assembly 10 including a door frame 11 having a top head jamb 12, a side hinge jamb 13, a side latch jamb 14, and a bottom threshold 15 that collectively define the doorway 18 through the door frame 11. The door frame assembly 10 includes a door 20 hingedly mounted to the hinge jamb 13 so that the door 20 can pivot between an open position and a closed position. The door 20 includes a latch assembly 21 having a handle 22, such as a rotatable handle or doorknob, which cooperates with a latch 23 to retract and extend the latch 23 into and out of the door, respectively. The latch jamb 14 includes a strike plate 16 having an opening (not shown) therethrough for receiving the door latch 23. When the door 20 is in the closed position, the latch 23 extends through the strike plate opening to secure the door 20 in the closed position. The door handle 22 may have a home position with the latch 23 in an extended position to maintain the latch 23 secured through the strike plate opening and the door 20 secured in the closed position. The door handle 22 may be rotated to retract the latch 23 from the strike plate opening and thereby allow the door 20 to be pivoted open. The exemplary door frame assembly 10 and its operation as described above are well known in the art.

Figure 2:
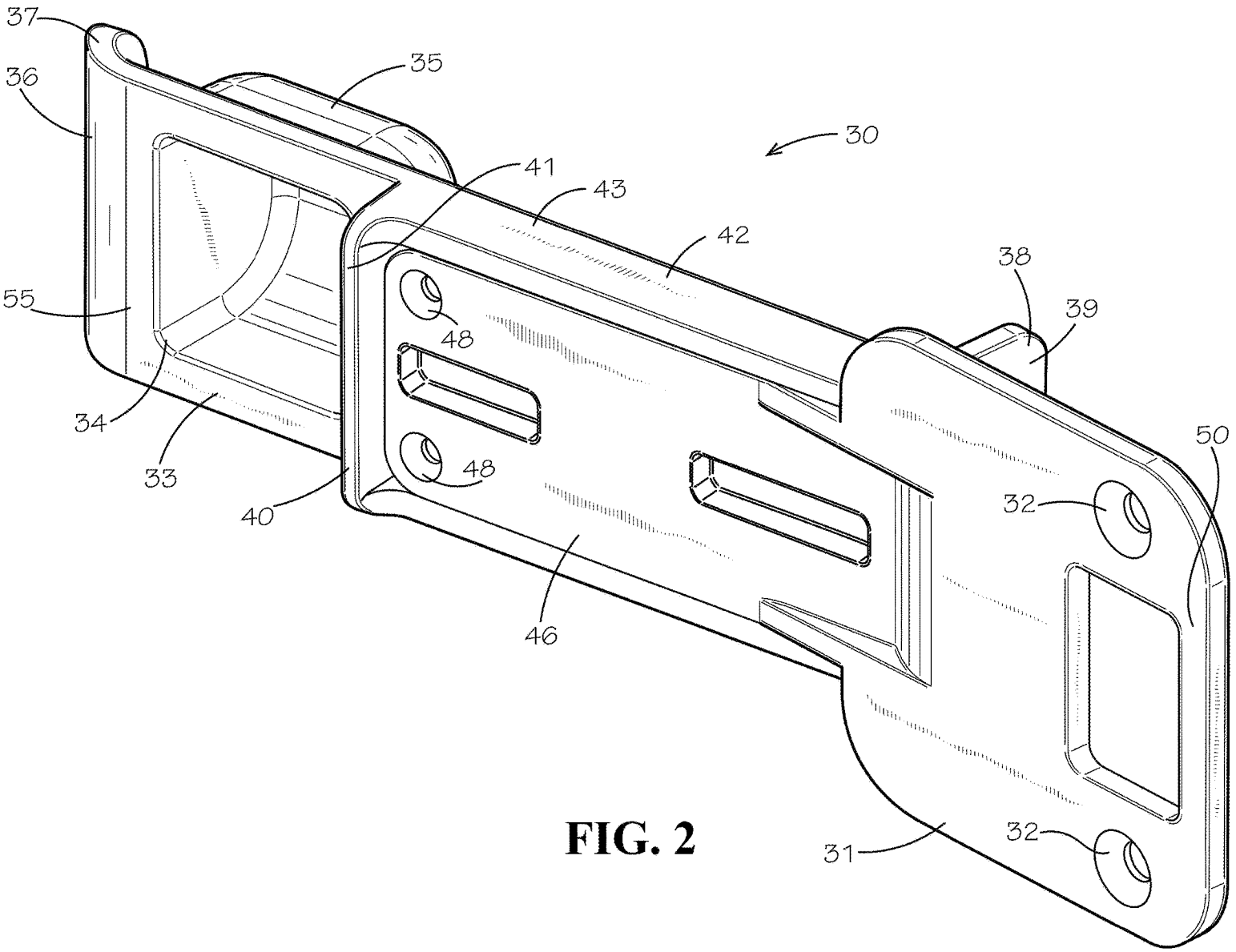
FIG. 2 illustrates by perspective view an exemplary implementation of a door prop apparatus.
Figure 3:
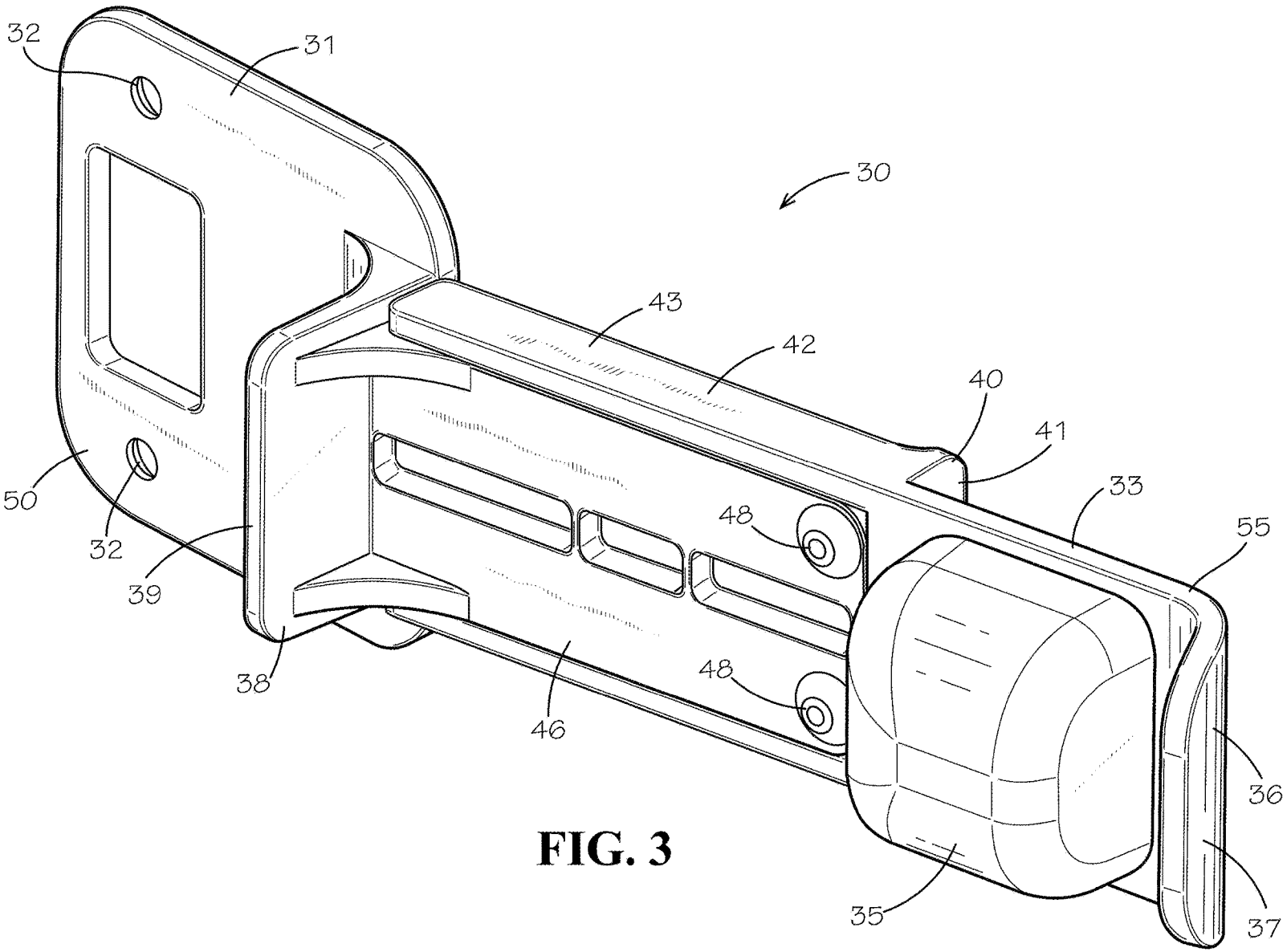
FIG. 3 illustrates by another perspective view the exemplary implementation of the door prop apparatus of FIG. 2.
Figure 4:
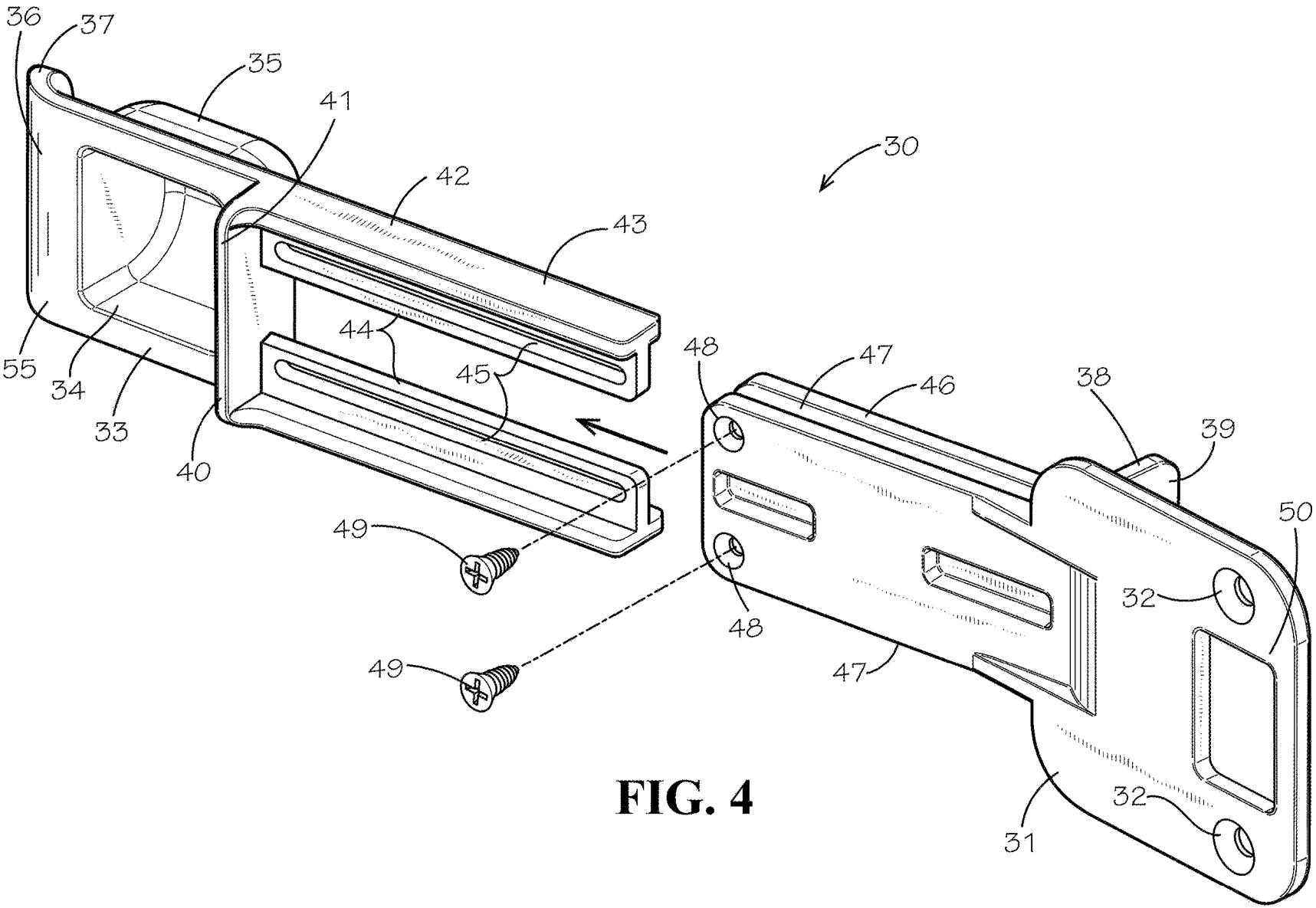
FIG. 4 illustrates by exploded perspective view the exemplary implementation of the door prop apparatus of FIG. 2.

A door prop apparatus 30, as disclosed herein, is adapted to secure a door, such as door 20, in a partially opened position relative to a door frame, such as door frame 11, in various aspects. The "partially opened position" created by the door prop apparatus 30 is preferably a gap of at least 1 inch between the door and the door frame, more preferably a gap of 1 to 12 inches, and most preferably a gap of 2 to 6 inches. FIGS. 2-4 illustrate exemplary door prop apparatus 30, which includes a mounting member 31 formed at a proximal end 50 of the door prop apparatus 30, the mounting member 31 adapted to attach to the latch jamb 14 and thereby secure the apparatus 30 to the latch jamb 14. The mounting member 31 may replace a pre-existing strike plate 16 on the latch jamb 14. The mounting member 31 may include one or more holes 32 for receiving fasteners (not shown), such as nails or screws, therethrough to secure the mounting member 31 to the latch jamb 14.

The door prop apparatus 30 includes a latch receiving member 33 adapted to receive and secure the door latch 23. The latch receiving member 33 includes an opening 34 for receiving the latch 23 therethrough. The opening 34 may include an integral cover 35. The latch receiving member 33 is adapted to receive and reversibly secure the latch 23 in the latch receiving member 33 as the door 20 is urged from an open position towards a closed position. Thus, the door 20 may be reversibly secured in a partially opened position when the latch 23 is secured within the latch receiving member 33 and the mounting member 31 is attached to the latch jamb 14, in various aspects. The door handle 22 is preferably operable to retract the latch 23 into the door 20 and thereby release the door 20 from the secured partially opened position. As used herein, the door "handle" may include other mechanisms to retract the latch 23 into the door 20 and thereby release the door 20 from the secured partially opened position such as, for example, secure door access controls that require a swipe card, biometric verification, or security code to actuate automated retraction of the latch 23 into the door 20.

The door prop apparatus 30 preferably includes a biasing member 36 adapted to engage the latch 23 and guide the latch 23 towards the latch receiving member 33 as the door 20 is urged from an open position towards a closed position. The biasing member 36 may be a curved surface 37 formed along the distal edge of a distal end 55 of the door prop apparatus 30, as shown in the exemplary door prop apparatus 30. The door prop apparatus 30 may include another biasing member 38 adapted to engage the side latch jamb 14 and thereby bias the latch receiving member 33 towards an axis A through the doorway 18. The biasing member 38 may be a projection 39 formed on the proximal end 50 of the door prop apparatus 30 and extending substantially perpendicular to a surface of the mounting member 31, as shown in the exemplary door prop apparatus 30.

The door prop apparatus 30 may include a door stop member 40 adapted to engage the door 20 and prevent the door 20 from advancing past the door stop member 40 as the door 20 is urged from an open position towards a closed position. The door stop member 40 may be a flange or similar projection 41 extending substantially perpendicular to a surface of the latch receiving member 33, as shown in the exemplary door prop apparatus 30.

The door prop apparatus 30 may include an extension member 42 between the mounting member 31 and the latch receiving member 33. The length of the extension member 42 may be adjustable to vary the distance between the mounting member 31 and the latch receiving member 33, in various aspects. For example, extension member 42 may include a first coupling member 43 having opposing extensions 44 for slidably engaging opposing tracks 47 formed in a second coupling member 46. The extensions 44 may include one or more elongated slots 45. The second coupling member 46 may include one or more screw holes 48 that are aligned with the slots 45 such that one or more screws 49 can be reversibly secured through the screw hole(s) 48 and slot(s) 45 to reversibly secure the second coupling member 46 to the first coupling member 43. Thus, the extension member 42 may be telescoping in length by slidably adjusting the first coupling member 43 relative to the second coupling member 46 and then reversibly securing the coupling members 43, 46 together by tightening of the screws 49, in various aspects.

Figure 5:
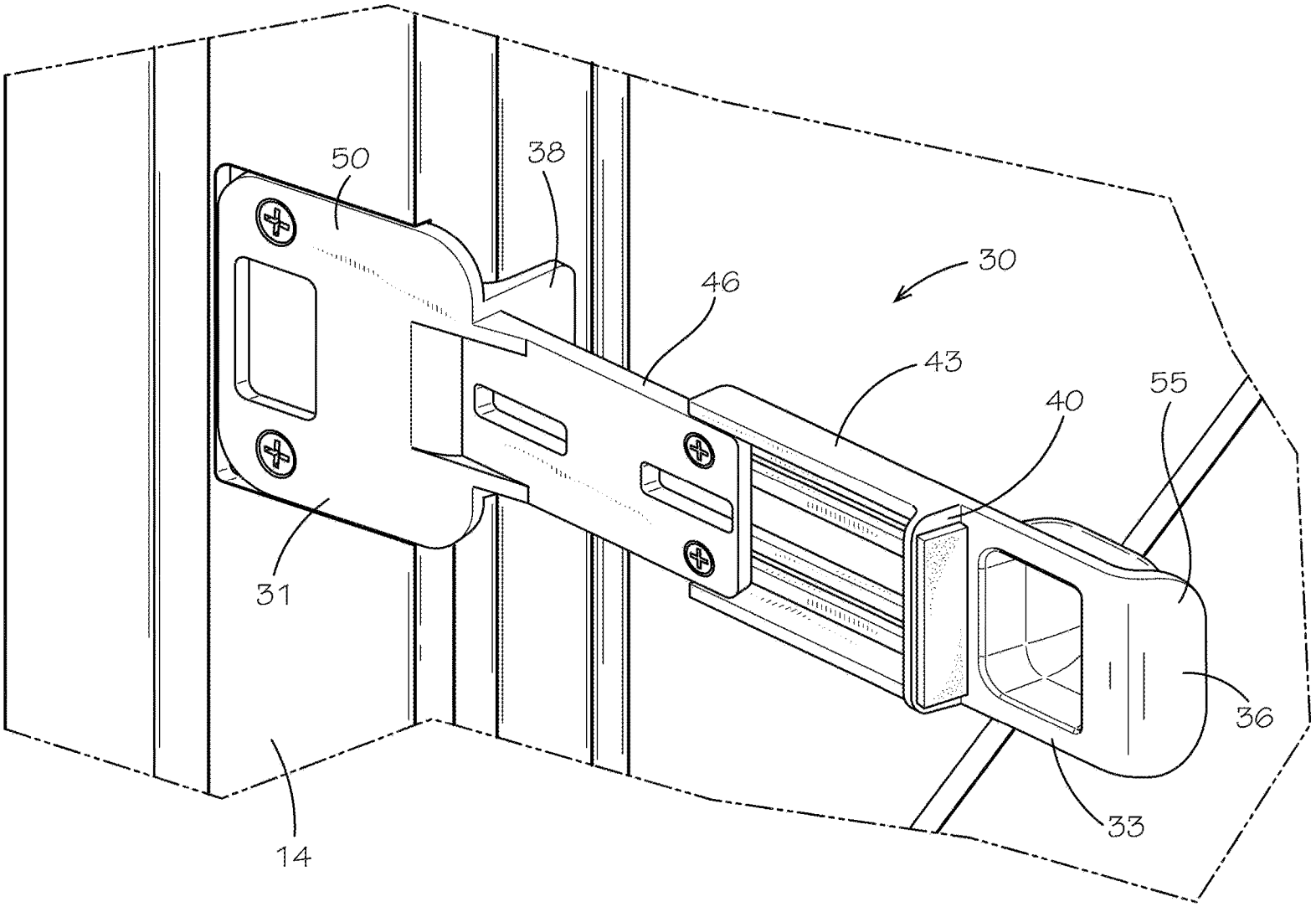
FIG. 5 illustrates by perspective view an exemplary implementation of the door prop apparatus attached to a door frame side latch jamb.
Figure 7:
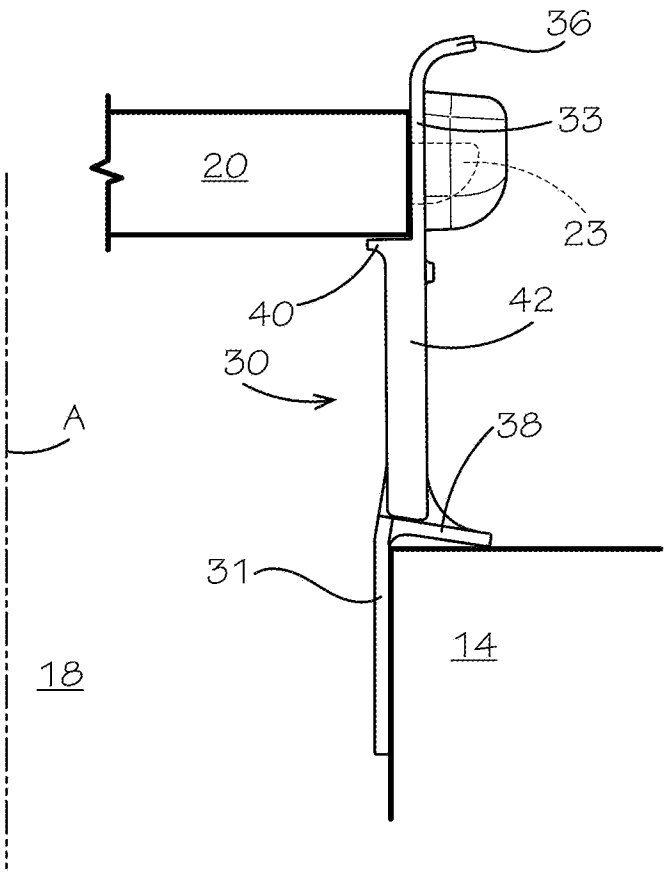
FIG. 7 illustrates by top schematic view portions of the exemplary implementation of the door prop apparatus of FIG. 5 securing a door.
Figure 6:
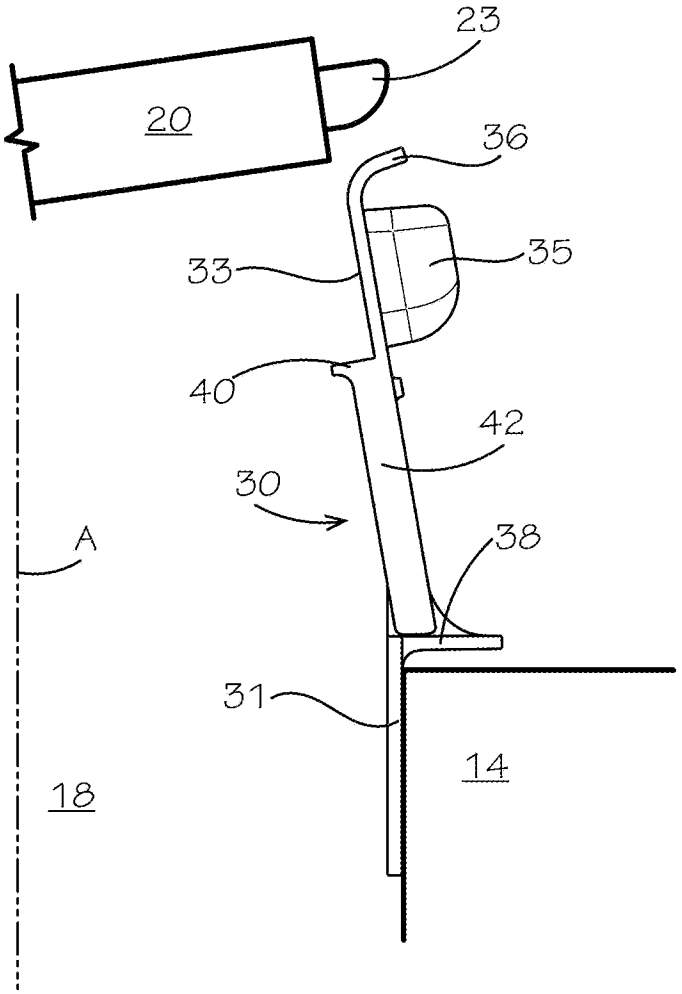
FIG. 6 illustrates by top schematic view portions of the exemplary implementation of the door prop apparatus of FIG. 5 in proximity to a door.

A method of securing a door, such as exemplary door 20, in a partially opened position relative to a door frame, such as exemplary door frame 11, using a door prop apparatus, such as exemplary door prop apparatus 30, is disclosed herein, in various aspects. With reference to FIGS. 5-7, an exemplary method includes securing the door prop apparatus 30 to the door latch jamb 14 by attaching the mounting member 31 to the latch jamb 14, in various aspects. If the latch jamb 14 includes a strike plate, such as strike plate 16, the strike plate can first be removed and then the mounting member 31 can be mounted at the location where the strike plate had been mounted. After the mounting member 31 has been mounted to the latch jamb 14, thereby securing the door prop apparatus 30 to the latch jamb 14, the biasing member 38 (e.g., projection 39) is operable to engage the latch jamb 14 and bias the distal end 55 of the door prop apparatus 30, including the latch receiving member 33, towards the axis A through the doorway 18.

After the mounting member 31 has been mounted to the latch jamb 14, the door 20 is urged from an open position towards a closed position. As the door 20 is urged from the open position towards the closed position, the door 20 engages the door prop apparatus 30 and the door latch 23 engages the biasing member 36 (e.g., curved edge 37), which guides the latch 23 towards the latch receiving member opening 34 in the latch receiving member 33. As the door 20 is further urged from the open position towards the closed position, the latch 23 moves into the latch receiving member opening 34 and is thereby reversibly secured by the latch receiving member 33, wherein the door 20 is secured in the partially opened position when the latch 23 is secured within the latch receiving member 33. After the latch 23 moves into the latch receiving member opening 34, the door 20 engages the door stop member 40, which halts further movement of the door 20 towards the closed position.

The extension member 42 may be adjusted to vary the distance between the mounting member 31 and the latch receiving member 33, thus allowing the gap between the door 20 and the door frame 11 to be adjusted according to user preference. The door handle 22 may be rotated to retract the latch 23 out of engagement with the latch receiving member 33 and thereby release the door 20 from the partially opened position. As noted above, other mechanisms, such as secure door access controls, may be used to retract the latch 23 out of engagement with the latch receiving member 33 and thereby release the door 20 from the partially opened position.

The foregoing discussion along with the Figures discloses and describes various exemplary implementations. These implementations are not meant to limit the scope of coverage, but, instead, to assist in understanding the context of the language used in this specification and in the claims. The Abstract is presented to meet requirements of 37 C.F.R. § 1.72(b) only. Accordingly, the Abstract is not intended to identify key elements of the apparatus and methods disclosed herein or to delineate the scope thereof. Upon study of this disclosure and the exemplary implementations herein, one of ordinary skill in the art may readily recognize that various changes, modifications and variations can be made thereto without departing from the spirit and scope of the inventions as described herein and as defined in the following claims.

The invention claimed is:

1. A door prop apparatus for securing a door in a partially opened position relative to a door frame defining a doorway, the door having a handle operably connected to a retractable latch and the door frame having a side latch jamb, the apparatus comprising:

a proximal mounting member adapted to attach to the side latch jamb and thereby secure the apparatus to the side latch jamb;

a distal latch receiving member adapted to receive the latch therein; and an extension member between the mounting member and the latch receiving member, wherein the extension member is telescopically adjustable to vary a distance between the mounting member and the latch receiving member;

wherein the latch receiving member is operable to receive the latch and reversibly secure the latch in the latch receiving member as the door is urged from an open position towards a closed position;

wherein the door is secured in the partially opened position when the latch is secured within the latch receiving member and the mounting member is attached to the side latch jamb;

wherein the handle is operable to retract the latch into the door, wherein the door is releasable from the partially opened position when the latch is retracted into the door.

2. An apparatus according to claim 1, further comprising a first biasing member distal to the latch receiving member, wherein the first biasing member is operable to engage the latch and guide the latch toward the latch receiving member as the door is urged from the open position towards the closed position.

3. An apparatus according to claim 2, wherein the first biasing member is a curved surface.

4. An apparatus according to claim 2, further comprising a second biasing member adapted to engage the side latch jamb and thereby bias the latch receiving member towards an axis through the doorway.

5. An apparatus according to claim 1, further comprising a door stop member proximal to the latch receiving member, wherein the door stop member is operable to engage the door and prevent the door from advancing past the door stop member as the door is urged from the open position towards the closed position.

6. A door prop apparatus for securing a door in a partially opened position relative to a door frame defining a doorway, the door having a rotatable handle operably connected to a retractable latch and the door frame having a side latch jamb, the apparatus comprising:

a proximal mounting member adapted to attach to the side latch jamb and thereby secure the apparatus to the side latch jamb;

a distal latch receiving member adapted to receive the latch therein;

an extension member between the mounting member and the latch receiving member, wherein a length of the extension member is telescopically adjustable to vary a distance between the mounting member and the latch receiving member;

a first biasing member adapted to engage the latch, the first biasing member distal to the latch receiving member;

a door stop member adapted to engage the door, the door stop member proximal to the latch receiving member; and a second biasing member adapted to engage the side latch jamb and thereby bias the latch receiving member towards an axis through the doorway;

wherein the first biasing member is operable to engage the latch and guide the latch towards the latch receiving member as the door is urged from an open position towards a closed position;

wherein the latch receiving member is operable to receive the latch and reversibly secure the latch in the latch receiving member as the door is urged from the open position towards the closed position;

wherein the door stop member is operable to engage the door and prevent the door from advancing past the door stop member as the door is urged from the open position towards the closed position;

wherein the door is secured in the partially opened position when the latch is secured within the latch receiving member and the mounting member is attached to the side latch jamb;

wherein the handle is operable to retract the latch into the door when the handle is rotated, wherein the door is releasable from the partially opened position when the latch is retracted into the door.

7. An apparatus according to claim 6, wherein the first biasing member is a curved surface.

8. A method of securing a door in a partially opened position relative to a door frame defining a doorway, the door frame having a side hinge jamb and an opposing side latch jamb, the door hingedly mounted to the side hinge jamb and having a handle operably connected to a retractable latch, the method comprising the steps of:

1) Providing a door prop apparatus, comprising:

a) a proximal mounting member adapted to attach to the side latch jamb and thereby secure the apparatus to the side latch jamb;

b) a distal latch receiving member adapted to receive the latch therein; and c) an extension member between the mounting member and the latch receiving member, wherein the extension member is telescopically adjustable to vary a distance between the mounting member and the latch receiving member;

2) Removing a strike plate from the side latch jamb;

3) Attaching the mounting member to the side latch jamb in a place where the strike plate had been mounted;

4) Urging the door from an open position towards a closed position; and

5) Engaging the door prop apparatus with the door, wherein the latch receiving member receives the latch and reversibly secures the latch in the latch receiving member as the door engages the door prop apparatus, wherein the door is secured in the partially opened position when the latch is secured within the latch receiving member.

9. A method according to claim 8, wherein the handle is operable to retract the latch into the door, wherein the door is releasable from the partially opened position when the latch is retracted into the door.

10. A method according to claim 8, wherein the door prop apparatus further comprises a first biasing member distal to the latch receiving member, wherein the first biasing member is operable to engage the latch and guide the latch toward the latch receiving member as the door is urged from the open position towards the closed position.

11. A method according to claim 10, wherein the door prop apparatus further comprises a second biasing member adapted to engage the side latch jamb and thereby bias the latch receiving member towards an axis through the doorway.

12. A method according to claim 8, wherein the door prop apparatus further comprises a door stop member proximal to the latch receiving member, wherein the door stop member is operable to engage the door and prevent the door from advancing past the door stop member as the door is urged from the open position towards the closed position.

* * * * *